United States Patent [19]

O'Conke

[11] Patent Number: 5,046,212

[45] Date of Patent: Sep. 10, 1991

[54] TOOTHBRUSH

[76] Inventor: James R. O'Conke, 4245 E. 71st St., Cleveland, Ohio 44105

[21] Appl. No.: 470,084

[22] Filed: Jan. 25, 1990

[51] Int. Cl.[5] ..... A46B 9/04

[52] U.S. Cl. ..... 15/105; 15/167.1; 132/328

[58] Field of Search ..... 15/105, 111, 167.1, 15/167.2; D4/104, 108; 132/328, 321, 329

[56] References Cited

U.S. PATENT DOCUMENTS

| | | | |
|---|---|---|---|
| D.283,761 | 5/1986 | Chen | D4/108 |
| 958,371 | 5/1910 | Danek | 15/167.1 |
| 1,059,426 | 4/1913 | Barnes | 15/167.1 |
| 1,495,675 | 5/1924 | Colt | 15/111 |
| 2,267,670 | 12/1941 | Rosenwasser | 15/167.1 |
| 2,579,343 | 12/1951 | Sherland | 15/167.1 |
| 4,288,883 | 9/1981 | Dolinsky | 15/167.1 |
| 4,356,585 | 11/1982 | Protell et al. | 15/111 |
| 4,638,521 | 1/1987 | Potente et al. | 15/167.1 |
| 4,667,360 | 5/1987 | Marthaler et al. | D4/104 |

FOREIGN PATENT DOCUMENTS

| | | | |
|---|---|---|---|
| 520692 | 1/1956 | Canada | 15/167.1 |
| 537362 | 11/1931 | Fed. Rep. of Germany | 15/105 |
| 601558 | 8/1934 | Fed. Rep. of Germany | 15/167.1 |
| 674203 | 1/1930 | France | 15/167.1 |
| 592300 | 4/1959 | Italy | 15/167.1 |
| 85401 | 2/1936 | Sweden | 15/167.1 |
| 7787 | of 1886 | United Kingdom | 15/167.1 |
| 17423 | of 1896 | United Kingdom | 15/167.1 |

*Primary Examiner*—Harvey C. Hornsby
*Assistant Examiner*—Mark Spisich
*Attorney, Agent, or Firm*—Pearne, Gordon, McCoy & Granger

[57] ABSTRACT

A toothbrush for improved dental hygiene providing a body formed with a curved bristle head joined to a substantially straight handle by an offset neck. The curved bristle head tangentially joins the neck and extends therefrom with a decreasing radius of curvature to the extremity thereof. A plurality of bristle bundles are mounted on the concave side of the bristle head and extend substantially perpendicular to a cord joining the ends of the bristle head to free ends located in a flat plane substantially parallel to such cord. A retractable toothpick is mounted in the end of the handle remote from the bristle head and is movable between a retracted position within the handle and an extended position in which it extends beyond the end of the handle.

5 Claims, 2 Drawing Sheets

TOOTHBRUSH

BACKGROUND OF THE INVENTION

This invention relates generally to toothbrushes, and more particularly to a novel and improved toothbrush structure which is effective in efficiently cleaning all tooth surfaces even in hard-to-reach locations.

PRIOR ART

The accumulation of plaque on teeth is one of the most common causes of tooth loss. Prior toothbrushes have been formed in many shapes and sizes in attempts to provide for efficient removal of such plaque and to provide good dental hygiene. Examples of toothbrushes having offset neck portions are illustrated in U.S. Pat. Nos. 2,736,917 and 4,330,896. Examples of toothbrushes having curved bristle heads are illustrated in U.S. Pat. Nos. 281,202; 1,639,880; 1,927,365; 2,445,657; 2,579,342; 2,845,645; and 4,800,608. Examples of toothbrushes having rubber tips projecting from the end of the handle remote from the bristles for massaging the gums are illustrated in U.S. Pat. Nos. 2,736,917 and 2,800,899.

SUMMARY OF THE INVENTION

The present invention provides a novel and improved toothbrush structure which can be conveniently and efficiently used to clean virtually all tooth areas, and thereby provides optimum removal of plaque and overall improved dental hygiene. The structure is arranged to allow the user to reach even the posterior tooth surfaces with a minimum stress on the adjacent lip and cheek tissue to minimize user discomfort when the toothbrush is used.

The illustrated preferred embodiment provides a body having a bristle head at one end and an offset neck connecting the bristle head to a straight handle. The bristle head is curved with a decreasing radius of curvature towards its extremity, and is angled with respect to the length of the handle. The offset neck and the angled relationship of the bristle head, along with the curved shape thereof, facilitate the cleaning of posterior teeth and embrasures thereof without requiring substantial displacement of the lips and teeth tissue.

Further, the bristles which extend from the concave side of the bristle head extend to free ends located in a plane substantially parallel to a cord extending between the ends of the bristle head. Since the bristle ends lie in a straight line or plane, all of the bristles are operable to clean the more accessible tooth surfaces. However, the bristle length at the extremity of the bristle head is short, positioning such end close to the teeth when cleaning embrasures. This is particularly desirable when cleaning posterior tooth surfaces. Further, the short bristles at the extremity of the bristle head are less flexible, due to their short length, and are therefore very effective in cleaning embrasures and the like.

The illustrated embodiment also provides a rigid, retractable toothpick at the end of the handle remote from the bristle head. This toothpick is curved to facilitate its use in crevices between teeth even in the posterior portions of the mouth.

With this invention, an efficient, easily used structure of a toothbrush is provided for better plaque removal and improved dental hygiene.

These and other aspects of this invention are illustrated in the accompanying drawings, and are more fully described in the following specification

DETAILED DESCRIPTION OF THE DRAWINGS

Figure 1:
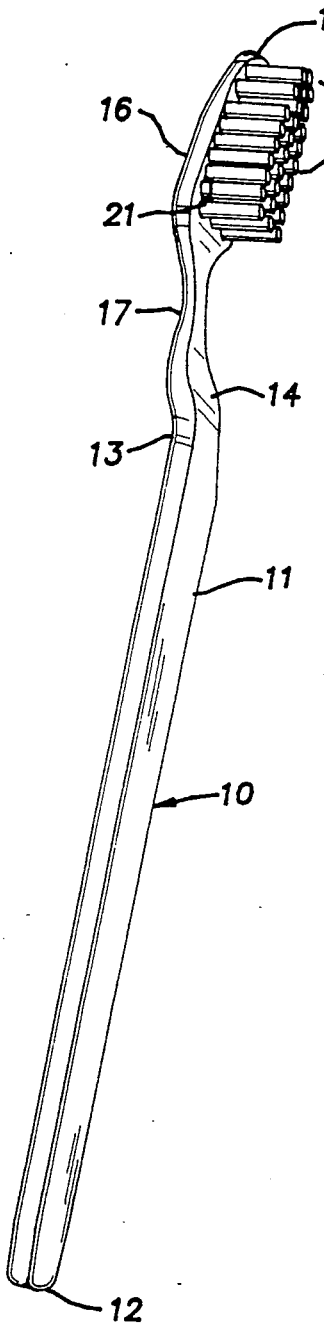
FIG. 1 is a perspective view of a toothbrush in accordance with this invention.
Figure 2:
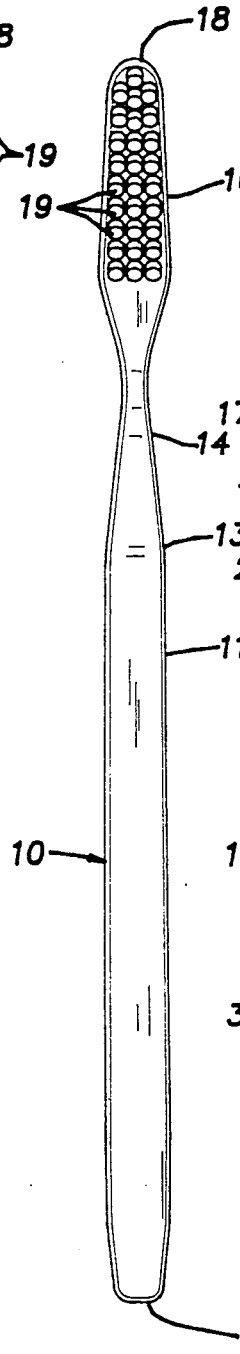
FIG. 2 is a longitudinal view of the toothbrush, illustrating the bristle side thereof.

The toothbrush provides a molded plastic body 10 having a substantially straight handle portion 11 extending from one end 12 of the body to a location 13, where it joins with an offset neck portion 14 which extends between the handle 11 and a bristle head 16.

Figure 3:
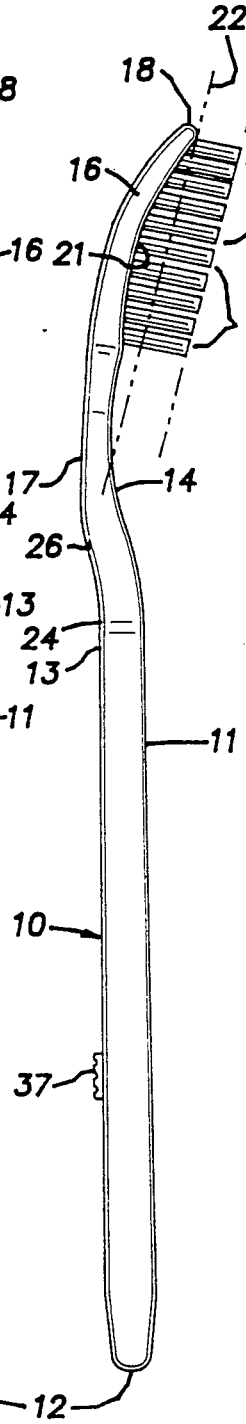
FIG. 3 is a side elevation of the toothbrush, illustrating the toothbrush when the toothpick is retracted into the handle.
Figure 3A:
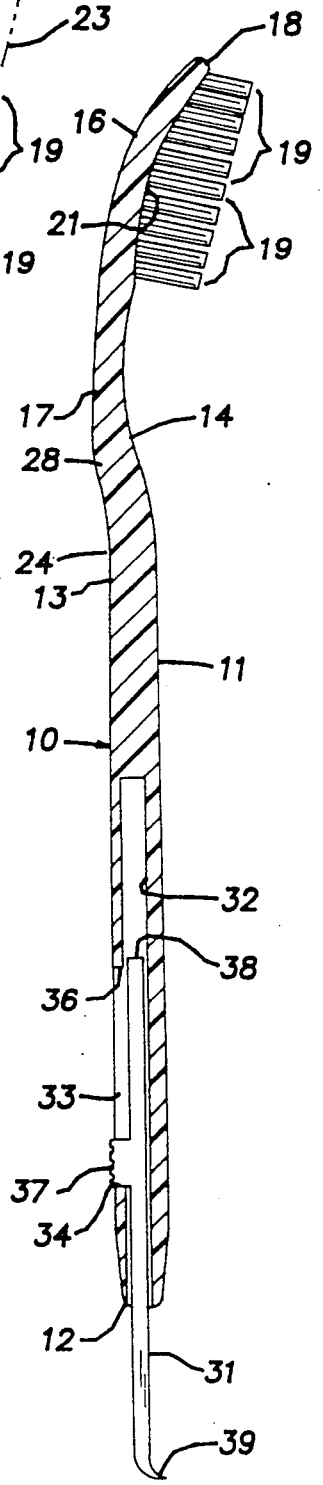
FIG. 3A is a view similar to FIG. 3 but in longitudinal section, illustrating the toothpick in the extended position.

The bristle head 16 is provided with a curved shape, best illustrated in FIGS. 3 and 3A, extending from its junction 17 with the neck 14. The curved bristle head provides a gradually decreasing radius of curvature substantially to the end 18. Mounted in the bristle head 16 are a plurality of bundles of bristles 19 which extend from the concave side 21 of the bristle head in a direction substantially perpendicular to a cord 22 joining the junction 17 and the end 18 of the bristle head. The bristles extend to free ends located in a flat plane 23 substantially parallel to the cord 22, as best illustrated in FIG. 3. As illustrated, the cord 22 and the plane 23 are inclined with respect to the length of the handle at an angle of about 15 degrees.

As best illustrated in FIGS. 3 and 3A, the back side 24 of the neck portion is angled inwardly from the location 13 to a location at about 26, resulting in a thinning of the neck portion 14. The neck portion 14 provides an offset in a direction toward the back side and opposite to the concave side 21 of the bristle head 16. The offset extends from about the location 13 to the location 26. From the location 26, the neck portion extends substantially straight to the junction 17 with the bristle head 16, where it tangentially joins the bristle head.

Figure 4:
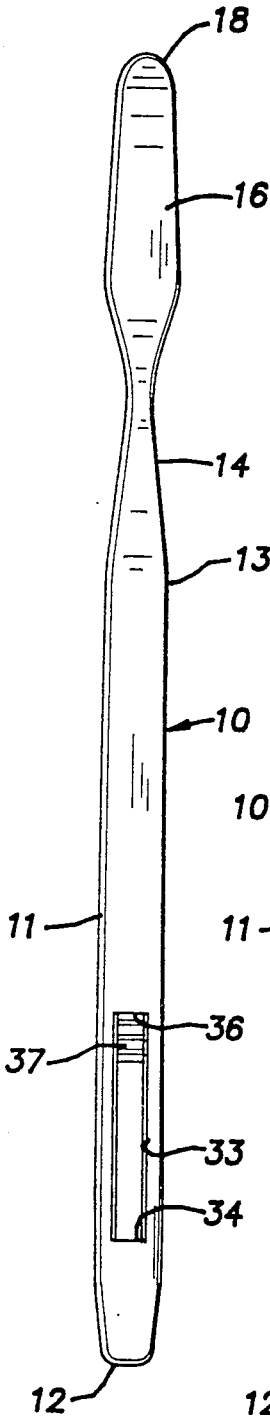
FIG. 4 is a longitudinal view of the toothbrush, taken from the side thereof opposite the bristles and illustrating the toothpick in the retracted position.
Figure 4A:
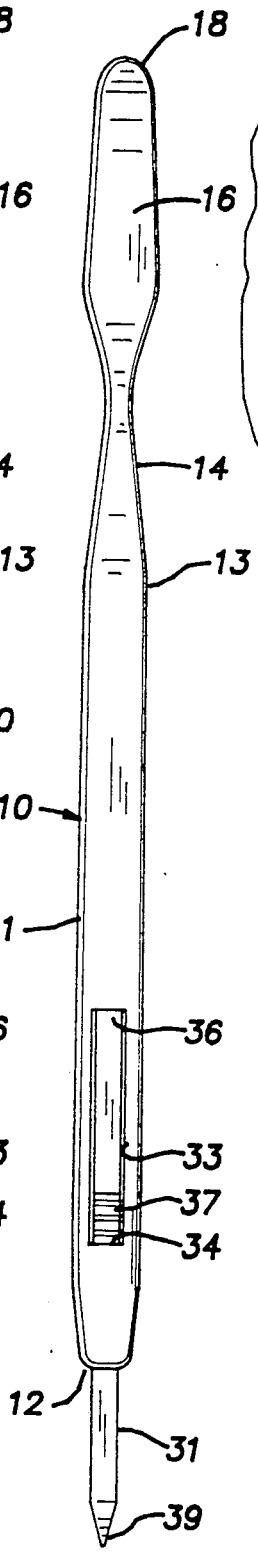
FIG. 4A is a view similar to FIG. 4, but illustrating the toothpick in the extended position.

Located in the end 12 of the handle is a rectractable toothpick 31 which extends into a longitudinal passage 32 formed in the handle 11. The back side of the toothbrush is provided with a slot 33 extending from one end 34 to its opposite end 36. The slot is open from the back side of the handle to the longitudinal passage 32. The toothpick and the longitudinal passage are provided with a substantially rectangular cross section sized to closely fit each other so that the toothpick is guided for longitudinal movement along the handle between an extended position illustrated in FIGS. 3A and 4A and a retracted position illustrated in FIGS. 3 and 4.

The toothpick 31 is provided with a lateral projection 37 extending through the slot 33 so that the user can move the toothpick between its extended and retracted positions. In its extended position, the projection engages the end 34 of the slot 33 and, in its retracted position, the projection 37 engages the ends 36 of the slot 33. With this structure, the toothpick itself is trapped within the handle for the limited movement between the retracted and extended positions.

In the extended position, the inner end 38 of the toothpick extends beyond the end 36 of the slot so that the toothpick is held in complete alignment with the handle. The free end of the toothpick is formed with a relatively sharp, curved point 39 so that the user can reach between teeth even in the posterior portion of the mouth. The toothpick is preferably formed of a rigid plastic material which provides strength but which will not scratch the teeth when it is in use.

Figure 5:
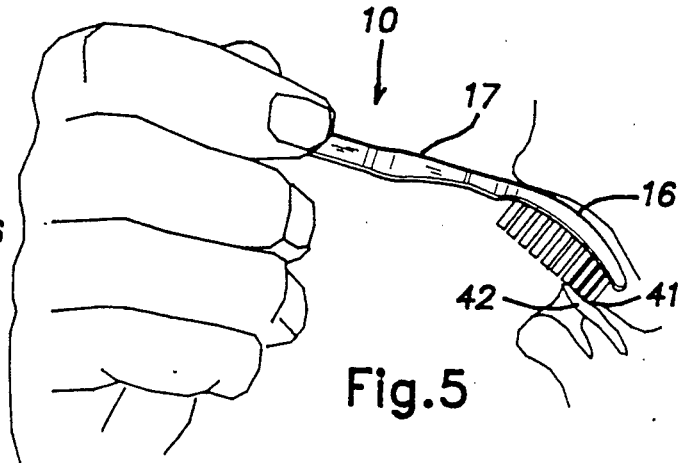
FIG. 5 is an illustration of the use of the toothbrush in the cleaning of the posterior side of the front teeth.
Figure 6:
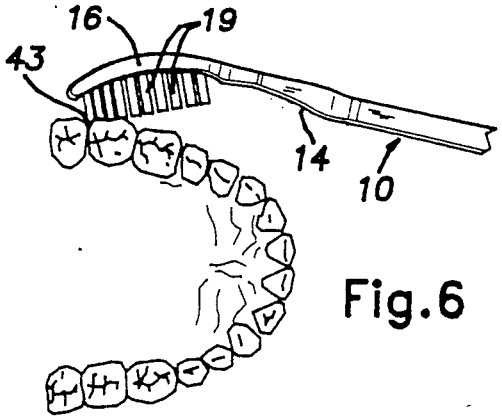
FIG. 6 illustrates the use of the toothbrush in cleaning embrasures along the outside of posterior teeth.
Figure 7:
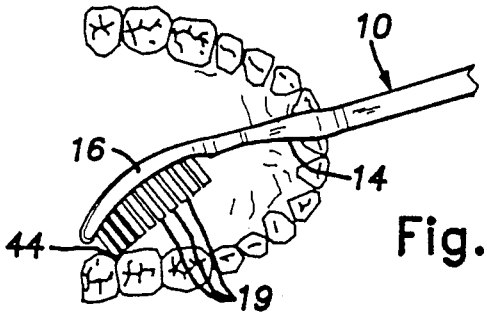
FIG. 7 is a view similar to FIG. 6, but illustrating the use of the toothbrush in cleaning interior embrasures between posterior teeth.

FIGS. 5 through 7 illustrate the manner in which the toothbrush in accordance with this invention can be efficiently used to clean even the posterior sides of the teeth in all portions of the mouth. The offset in the neck portion 14 and the curved shape of the bristle head 16 cooperate to allow access to even the most difficult to clean portions of the mouth without requiring extreme distortion or pulling of the lip and cheek tissue. As best illustrated in FIG. 5, it is possible to easily reach the posterior side 41 of the front teeth 42 without opening the mouth excessively. In such instance, the upper lip tends to engage the junction 17 between the bristle head 16 and the neck portion 14. Because the bristle head is curved, the mouth need not be open as wide as would be otherwise required.

FIG. 6 illustrates the manner in which the toothbrush is used to clean an outer embrasure 43 between back molars. Here again, the curved shape of the bristle head 16 cooperates with the offset neck portion 14 to provide good access to such embrasure without excessive distortion of the lip and cheek tissue of the user. Further, since the bristles 19 adjacent to the extremity of the bristle head are short, they are relatively stiff and provide good penetration into the embrasure 43 for efficient cleaning action. However, because the free ends of the bristles lie in a straight plane, the portions of the bristles along the entire length of the bristle head are efficient in the cleaning of more accessible areas of the teeth.

FIG. 7 illustrates the manner in which the brush can be used to efficiently clean an internal embrasure 44 adjacent to the back of the mouth. Here again, the curved bristle head and offset neck cooperate for ease of placement of the bristles at the extremity of the brush for efficient cleaning.

Figure 8:
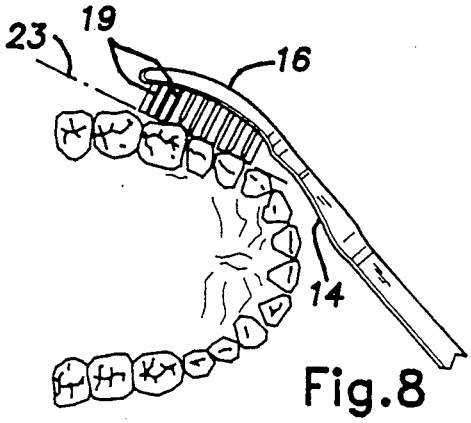
FIG. 8 is a view similar to FIGS. 6 and 7, illustrating the brushing of the more accessible tooth surfaces.

As best illustrated in FIG. 8, the brush is effective in cleaning the more accessible tooth surfaces since the free ends of the bristles are located in the straight plane 23.

Further, with the retractable toothpick, which is formed of substantially rigid material, the curved point can be used to reach between teeth at virtually any part of the mouth for efficient removal of debris caught between the teeth.

With this invention, an improved structure is provided for the efficient cleaning of teeth in all portions of the mouth, and in particular the efficient removal of plaque which, if not efficiently removed, is a principal cause of tooth loss.

Although the preferred embodiment of this invention has been shown and described, it should be understood that various modifications and rearrangements of the parts may be resorted to without departing from the scope of the invention as disclosed and claimed herein.

What is claimed is:

1. A toothbrush comprising a substantially rigid elongated body providing a curved bristle head at one end having a concave side, said bristle head having a length and a width, said length being substantially greater than said width, the curve of the bristle head being substantially in a single imaginary plane that extends along the elongated body, said body having a back side on the side of said body opposite said concave side, said body providing a neck portion joined at one end to said bristle head and at the other end to a substantially straight elongated handle portion, said neck portion providing an offset section adjacent said handle extending toward said back side, a first plane connecting ends of said bristle head being angled with respect to the length of said handle portion at an angle of about 15 degrees, a plurality of bristle bundles mounted on said concave side of said bristle head extending substantially perpendicularly to said first plane to free ends in a second plane substantially parallel to said first plane, said bristle bundles comprising an array, said array of bristle bundles having a length and a width, sid length being substantially greater than said width, said second plane containing said free ends of said bristles being inclined and offset relative to the length of said handle to allow said bristles adjacent the extremity of said bristle head to reach and efficiently clean embrasures and posterior surfaces of teeth throughout the mouth, the lengths of the bristles in relation to the curve of the bristle head being such that the major portions of the lengths of the majority of the bristles lie outside of said first plane, said bristle head extending from said neck portion to its extremity with a decreasing radius of curvature, said neck portion providing a substantially straight section extending from said offset to said bristle head, said straight section of said neck portion tangentially joining said bristle head, the first plane being oriented such that it intersects the straight section of the neck portion at a point intermediate said offset and said bristle head.

2. A toothbrush as set forth in claim 1, wherein a back side of the neck portion is angled inwardly to provide a thinning of the neck portion towards the bristle head.

3. A toothbrush as set forth in claim 1, wherein the end of said handle remote from said neck portion provides a longitudinal passage, and a retractable substantially rigid toothpick is mounted in said passage for movement from a retracted position within said handle to an extended position extending from said end of said handle.

4. A toothbrush as set forth in claim 3, wherein said handle provides a longitudinal slot along one side open to said passage, and said toothpick provides a lateral projection extending through said slot for moving said toothpick between said extended position and said retracted position.

5. A toothbrush as set forth in claim 1, wherein the end of said handle portion remote from said neck portion provides a longitudinal passage, and a retractable substantially rigid toothpick is mounted in said passage for movement from its retracted position within said handle to an extended position extending beyond the end of said handle.

* * * * *